US005971202A

United States Patent [19]

Filbrun

[11] Patent Number: 5,971,202

[45] Date of Patent: Oct. 26, 1999

[54] ICE CUBE RESTRAINING DEVICE

[76] Inventor: Roland Filbrun, 8201 St. Route 55, Springfield, Ohio 45502

[21] Appl. No.: 09/139,486

[22] Filed: Aug. 25, 1998

[51] Int. Cl.[6] ..... B65D 25/02

[52] U.S. Cl. ..... 220/719

[58] Field of Search ..... 220/719, 716, 220/713

[56] References Cited

U.S. PATENT DOCUMENTS

| | | | |
|---|---|---|---|
| D. 173,121 | 9/1954 | Lynn | D44/1 |
| D. 190,512 | 6/1961 | Ayala | D44/29 |
| D. 315,478 | 3/1991 | Liggens | D7/667 |
| D. 315,479 | 3/1991 | Liggens | D7/667 |
| D. 345,889 | 4/1994 | Herricks | D7/396.2 |
| D. 353,298 | 12/1994 | Hartpence, Jr., et al. | D7/400 |
| 586,833 | 7/1897 | Brown . | |
| 1,173,374 | 2/1916 | Nolda . | |
| 1,174,518 | 3/1916 | Nolda . | |
| 1,254,251 | 1/1918 | Magnus | 220/719 |
| 1,847,879 | 3/1932 | Knecht . | |
| 2,136,755 | 11/1938 | Prince | 65/13 |
| 2,555,766 | 6/1951 | Siczkiewicz, Jr. | 210/162 |
| 2,601,767 | 7/1952 | Wall | 220/719 |
| 2,690,064 | 9/1954 | Rupe | 65/13 |
| 2,753,050 | 7/1956 | Langston | 210/163 |
| 2,761,301 | 9/1956 | Tellier | 220/719 |
| 3,040,897 | 6/1962 | Holman | 210/244 |
| 3,360,161 | 12/1967 | Smith | 220/719 |
| 3,549,044 | 12/1970 | Lerner | 220/90.4 |
| 3,752,320 | 8/1973 | Biro | 210/469 |
| 4,184,603 | 1/1980 | Hamilton, Sr. | 220/254 |
| 4,842,157 | 6/1989 | Stone-Parker et al. | 220/90.4 |
| 4,938,375 | 7/1990 | Fantacone | 220/90.4 |
| 4,938,377 | 7/1990 | Jarvis | 220/719 |
| 5,370,258 | 12/1994 | Fair | 220/719 |

*Primary Examiner*—Stephen Castellano
*Attorney, Agent, or Firm*—Biebel & French

[57] ABSTRACT

An ice cube restraining device for restraining ice cubes in the bottom of a drink container. The device includes a plurality of contact patches for engaging the interior surface of the drink container, and flexible circumferential web pieces which extend between adjacent pairs of the contact patches to support the contact patches in a circumferential direction. The device further includes a central hoop member and a plurality of flexible web pieces which extend radially inwardly from the contact patches to the central hoop member to thereby support the contact patches in a radial direction.

15 Claims, 4 Drawing Sheets

ICE CUBE RESTRAINING DEVICE

FIELD OF THE INVENTION

The present invention relates to accessories for use with drink containers and, more particularly, to devices adapted to be positioned within drink containers for restraining objects, such as ice cubes, within the containers.

BACKGROUND OF THE INVENTION

A long recognized need for glasses or drink containers containing solid objects, such as ice cubes or the like relates to the ability to provide a mechanism for restraining the objects in the container while permitting sufficient flow of the drink from the container. Various devices have been proposed to accomplish this task with varying results.

For example, U.S. Pat. No. 1,173,374 to Nolda discloses a device for retaining ice in a glass wherein the device comprises a resilient outer ring supporting inwardly extending prongs. The device is formed with a conical shaped outer wall for frictional engagement with the inner surface of a glass, and therefore is limited to use in combination with drinking vessels having walls angled similar to the angle of the outer wall of the device.

U.S. Pat. No. 3,752,320 to Biro discloses a device for holding ice in a glass wherein the disclosed device is a molded plastic unit forming a screen, and a U-shaped portion at a center portion of the device acts as a spring to bias the device against the sides of the drinking glass. This device is limited in its range of use by the range of travel of the U-shaped spring member, such that the device may be used only with a limited range of drinking glass diameters.

U.S. Pat. No. 4,938,375 to Fantacone discloses a drinking receptacle and ice trap for use in combination with one another wherein the trap includes a side section for engaging the sides of a glass and a bottom section, the side and bottom sections are formed with concentrically arranged openings. The drink receptacle is specifically formed with an internal annular lip for cooperating with a rim on the trap such that the trap is not designed for use with a wide range of drink vessels.

U.S. Pat. No. 4,842,157 to Stone-Parker et al. attempts to address the shortcomings of the previously mentioned prior art and provides a retainer device for insertion in a drinking container wherein the device includes a solid central portion with S-shaped arms extending radially outwardly for engagement with the interior of a drink container. The arms are preferably provided with a rubber tip on the ends thereof for engaging glass and plastic drink containers. While this device provides an advantage over prior art devices in increasing the range of drink containers that the device may be used in, it is still limited in that the S-shaped or double curved arms, which are formed of plastic, will only be adapted to flex to a certain degree for insertion into smaller diameter drink containers, as limited by the dimensions and stiffness of the plastic material forming the arms.

Accordingly, there remains a need for a device for restraining ice in a drink container wherein the device is adapted to be used in a wide range of drink container sizes and which is of simple construction formed of a single homogeneous material, and not requiring a specially designed container to hold the device in place.

SUMMARY OF THE INVENTION

The present invention provides an ice cube restraining device for use in combination with a drink container having generally upright sides. The device includes a plurality of contact patches for engaging an interior surface of the drink container wherein the plurality of contact patches are substantially equally spaced from each other in a circumferential direction around an area circumscribed by an imaginary circle touching the outer edges of the contact patches. The contact patches are designed to engage the drink container at discrete locations for holding the restraining device at a desired vertical position within the container.

Flexible circumferential web pieces extend between adjacent pairs of the contact patches to exert a circumferentially extending force on the contact patches whereby the contact patches are supported, in a circumferential direction, by two of the circumferential web pieces. The contact patches are further supported in a radial direction by radial web pieces wherein a radial web piece extends radially inwardly toward a center portion of the restraining device from each of the contact patches. A central hoop member is engaged with the inner ends of each of the radial web pieces to provide a radial biasing force to each of the radial web pieces for controlling radial movement of the contact patches.

The central hoop member circumscribes a circular aperture at the center of the restraining device, and provides a flexible support for the inner ends of the web pieces wherein the central hoop member will flex and twist as the radial web pieces and contact patches are forced radially inwardly during insertion into a drink container. While the central hoop member, radial web pieces and circumferential web pieces provide support for the contact patches, the central circular aperture and an open annular area between the circumferential web pieces and the central hoop member provide a substantial unrestricted opening for fluid to flow past the restraining device.

The restraining device is formed of a highly flexible material which elastically deforms from a flat configuration to an upwardly concave configuration when in use positioned within a drink container. The highly flexible nature of the restraining device of the present invention permits the device to be used in a wide range of drink container diameters, and further facilitates easy insertion and removal of the device from the drink containers.

Therefore, it is an object of the present invention to provide a restraining device for use in a wide range of drink containers.

It is another object of the invention to provide a restraining device which is highly flexible and easily inserted into and removed from drink containers.

It is yet another object of the invention to provide a restraining device which is easily manufactured from a single homogeneous material.

Other objects and advantages of the invention will be apparent from the following description, the accompanying drawings and the appended claims.

DETAILED DESCRIPTION OF THE PREFERRED EMBODIMENT

Figure 1:
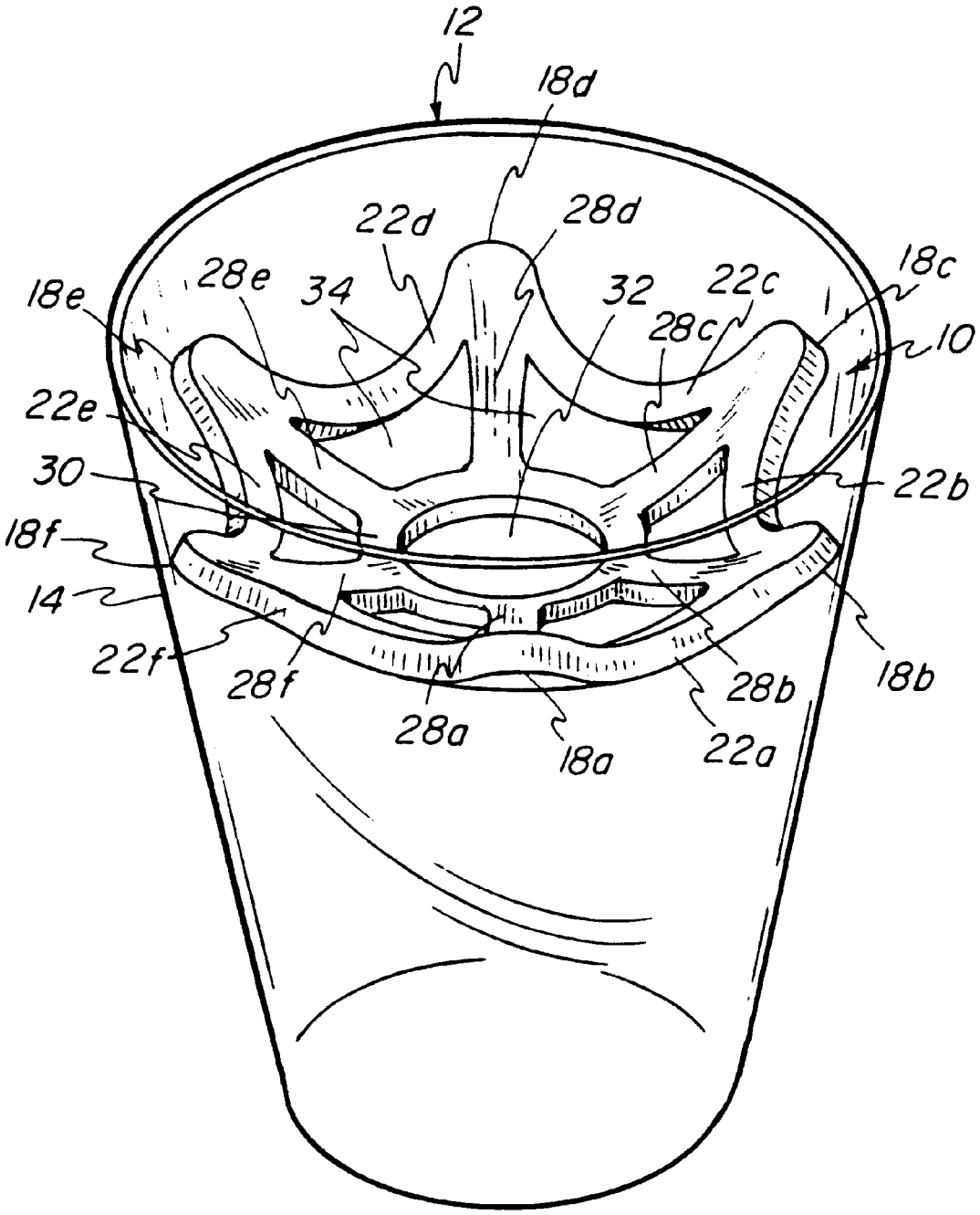
FIG. 1 is a perspective view of the ice cube restraining device of the present invention positioned in a large diameter glass.
Figure 2:
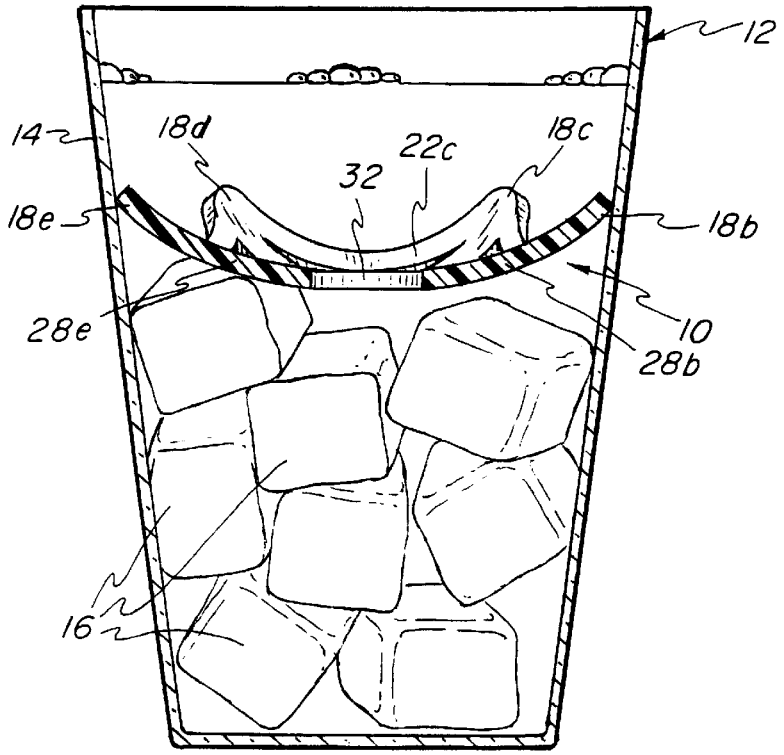
FIG. 2 is an elevational cross-sectional view thereof.

Referring to FIGS. 1 and 2, the present invention provides an ice cube restraining device 10 for use in combination with a drink container 12 having generally upright sides and preferably comprising a drinking glass having generally cylindrical sides 14. The restraining device 10 is adapted to be positioned within the drink container 12 and engaged with the interior surface of the sides 14 for retaining ice cubes 16 in a bottom portion of the drink container 12 while permitting fluid to flow freely through the restraining device 10 whereby ice cubes may be held immovably within the container 12 to prevent the ice cubes from sloshing or suddenly moving when the container 12 is tipped for drinking by a person.

Figure 3:
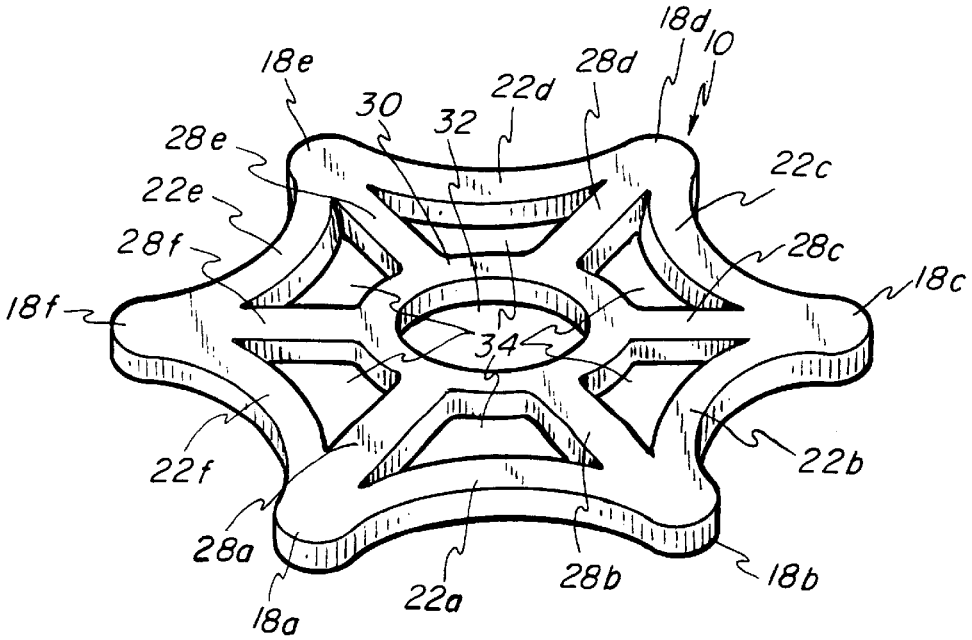
FIG. 3 is a perspective view of the ice cube restraining device in its non-use configuration.
Figure 4:
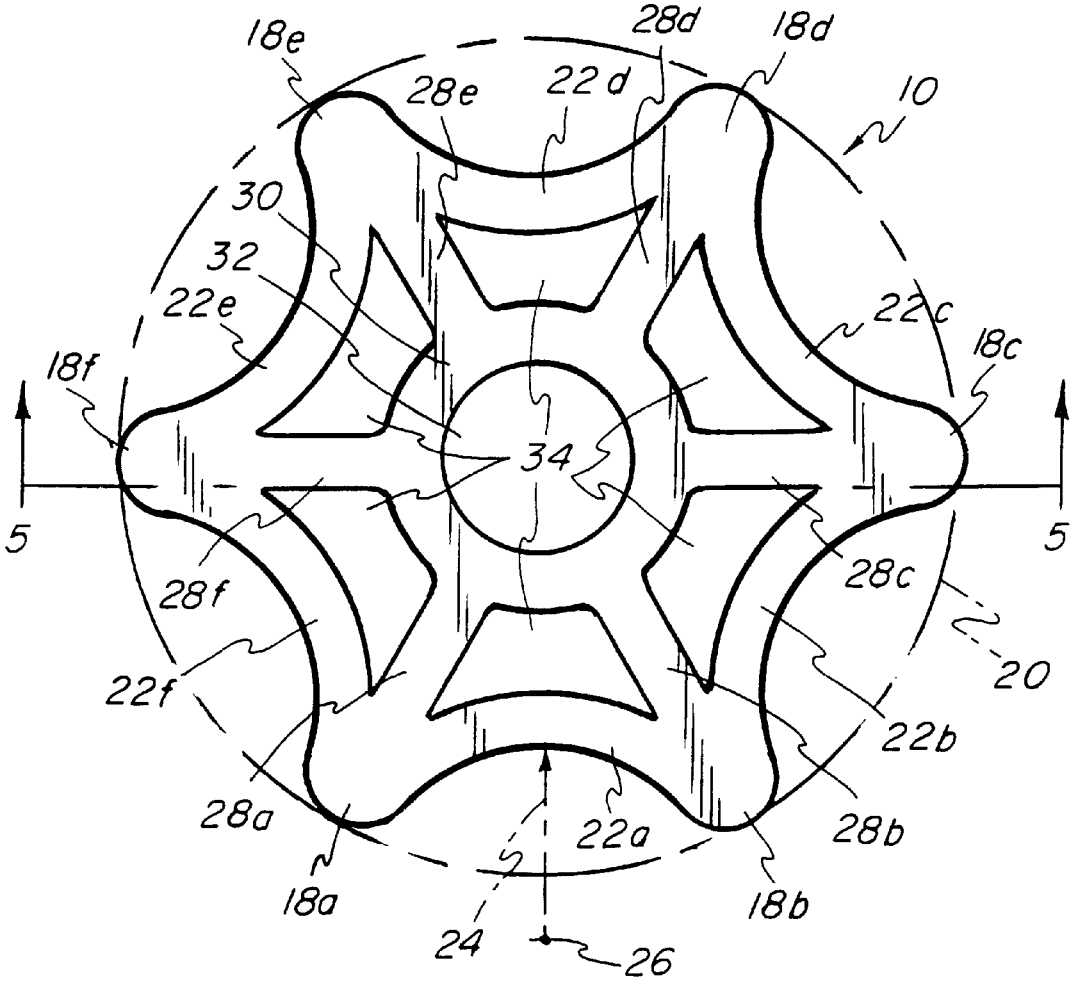
FIG. 4 is a top plan view thereof.
Figure 5:
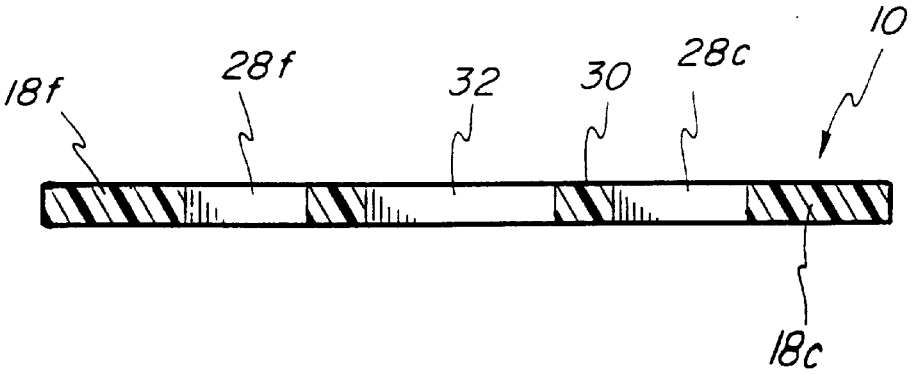
FIG. 5 is a cross-sectional view taken along line 5—5 in FIG. 4.

Referring additionally to FIGS. 3–5, the ice restraining device 10 includes a plurality of discrete contact patches 18*a–f* for engaging the interior surface of the drink container 12. The contact patches 18*a–f* are substantially equally spaced from each other in a circumferential direction within an area circumscribed by an imaginary circle 20 tangentially extending around the contact patches 18. It should be noted that although six contact patches 18 are illustrated in the drawings, the present invention is not limited to this particular number of contact patches 18 and any number of contact patches 18 which function in the manner described herein are considered within the scope of this invention.

A plurality of flexible circumferential web pieces 22*a–f* are formed integrally with the contact patches 18 wherein each of the circumferential web pieces 22*a–f* extend between adjacent pairs of the contact patches 18*a–f* such that each of the contact patches 18*a–f* is supported, in a circumferential direction, by two of the circumferential web pieces 22*a–f*. The circumferential web pieces 22*a–f* define arcuate members, each having a center of curvature located radially outwardly from a respective circumferential web piece, as is illustrated by radius line 24 extending from the center of curvature 26 for the circumferential web piece 22*a*. The circumferential web pieces 22 maintain the spacing between the contact patches to facilitate controlled movement of the contact patches 18 and avoid unwanted sideways distortion during insertion of the restraining device 10 in a drink container 12.

A plurality of flexible radial web pieces 28*a–f* are formed integrally with respective contact patches 18*a–f* and extend radially inwardly from the respective contact patches 18*a–f*. Inner ends of the radial web pieces 28 are integrally connected to a central hoop member 30 whereby the radial web pieces 28*a–f* support the respective contact patches 18*a–f* in a radial direction. The central hoop member 30 circumscribes a circular aperture 32, and the central hoop member is formed as a flexible member capable of twisting and bending movement in the radial and vertical directions to accommodate flexing of the restraining device 10 during insertion into a drink container 12 while also providing a stable support for biasing the contact patches 18 in the radial direction.

In addition, each of the radial web pieces 28*a–f* are formed having a width dimension, measured in the circumferential direction, which is greater than the width dimension of the contact patches 18*a–f*, and which is greater than the vertical thickness dimension of the radial web pieces. In this manner, the radial web pieces 28 are formed as highly flexible members for flexing in a vertical direction perpendicular to the horizontal plane of the restraining device 1O.

It should be noted that an open annular area 34 is defined between the circumferential web pieces 22 and the central hoop member 30 wherein the annular area 34 accommodates inward flexing of the circumferential web pieces 22. Also, the open annular area 34 and circular aperture 32 provide open areas through which fluids may freely flow through the restraining device 10 when it is positioned within a drink container 12.

The restraining device 10 is preferably formed of a single homogeneous polymeric material molded as an integral unit and is preferably formed of 55 durometer PVC. It should be understood that other materials may be used to provide a functional device and the restraining device 10 may be formed of other flexible, resilient materials having a durometer within the range of about 35–70 within the scope of the present invention. The main criteria for the material of the device being that it is highly elastic and of sufficient resiliency to provide good frictional engagement against the surface of a drinking glass while also providing sufficient rigidity to cause the device to bias the contact patches 18 against the sides of a glass or other drink container and to return to its normal configuration when not in use.

The restraining device 10 has a flat non-use configuration wherein the plurality of contact patches 18, the circumferential web pieces 22, the radial web pieces 28 and the central hoop member 30 all lie in a common plane, as is best seen in FIG. 5.

In addition, it can be seen that the device 10 is formed as a relatively thin structure which, in combination with the material comprising the device 10, enables the device 10 to function as a flexible structure which readily conforms to the interior of various drink containers.

Figure 6:
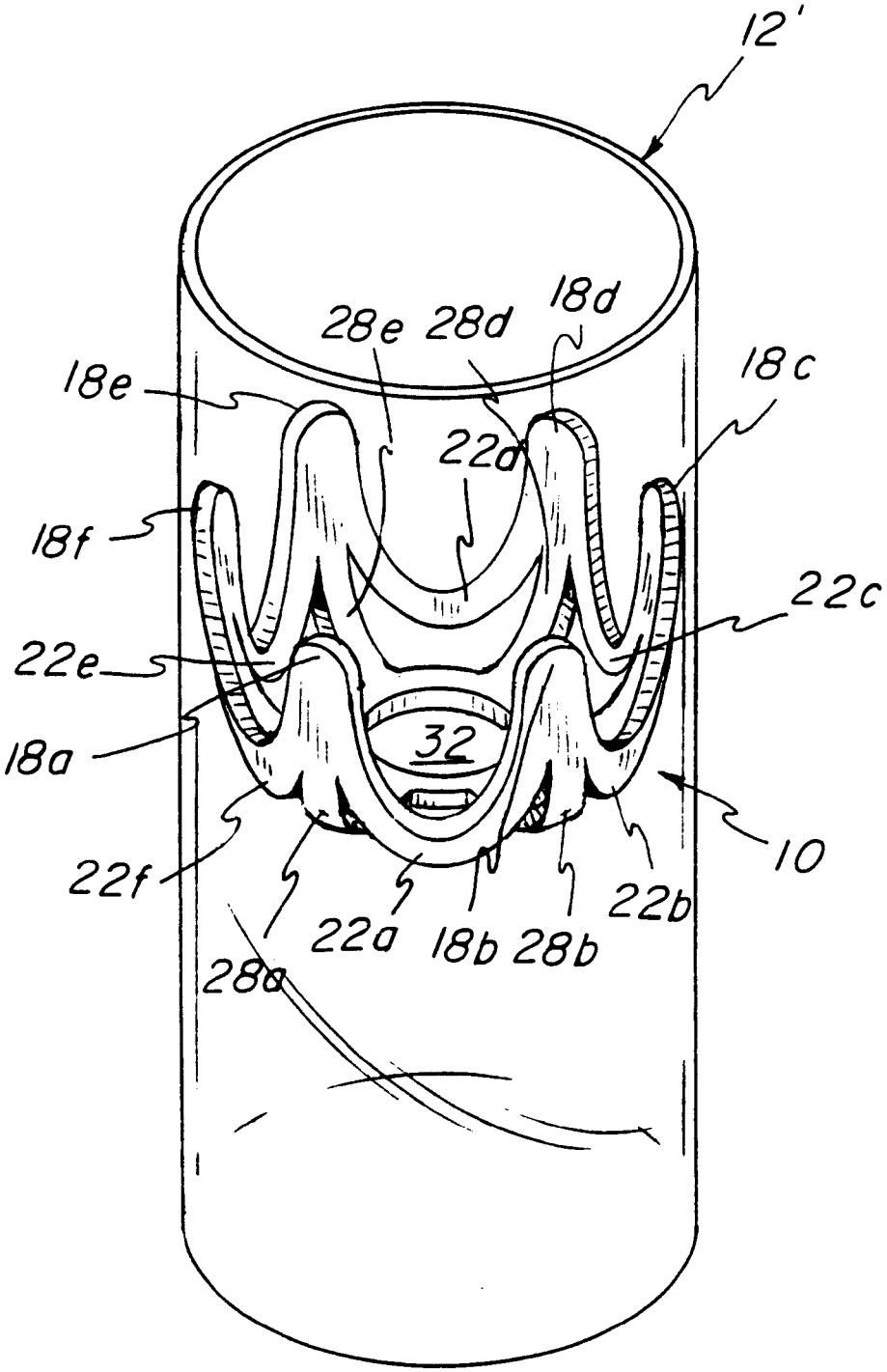
FIG. 6 is a perspective view of the ice cube restraining device positioned in a small diameter glass.

In a use configuration of the restraining device 10, the restraining device 10 takes on a smooth concave curve configuration with the contact patches 18 engaging the interior surface of a drink container 12, 12', as is best seen in FIGS. 2 and 6. FIG. 2 illustrates the restraining device 10 engaged with a drink container 12 which is of a maximum diameter the restraining device 10 is adapted to be used with, and FIG. 6 illustrates the restraining device 10 positioned in a container 12' having a minimum diameter the restraining device 10 is adapted to be used with. In the preferred embodiment, the restraining device 10 has a non-use diameter, as defined by the imaginary circle 20, of approximately 3½ inches, and the restraining device 10 is adapted to be used within drink containers having diameters ranging from about 3¼ inches to about 2 inches. Thus, the restraining device 10 is designed for use within containers having diameters ranging from about 93% to about 57% of the diameter of the imaginary circle 20 defined when the restraining device 10 is in its flat non-use configuration. Accordingly, the present invention provides a restraining device 10 which is designed to be used within drink containers having a wide range of diameters not heretofore provided by prior art ice restraining devices.

In use, the restraining device 10 may be grasped through the circular aperture 32 and inserted into a drink container 12 wherein the center of the restraining device is flexed downwardly, and the degree of downward flexing is dependent upon the particular diameter of the drink container 12. The spacing and outward biasing of the contact patches 18 is maintained through the circumferential and radial web pieces 18 and 28 in cooperation with the central hoop member 30 to maintain a sufficient outward biasing force on the contact patches 18 to maintain frictional engagement with the interior surface of the drink container 12 and, as can be seen by comparing FIGS. 2 and 6, the open annular area 34 is designed to accommodate varying degrees of flexing by the circumferential web pieces 22.

In addition to being highly adaptable to various drink containers, the flat non-use configuration of the present ice cube restraining device permits the device to be easily packaged and stored in a minimum of space.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An ice cube restraining device for use in combination with a drink container having generally upright sides, said restraining device comprising:

a plurality of contact patches for engaging an interior surface of a drink container, said plurality of contact patches being substantially equally spaced from each other in a circumferential direction within an area circumscribed by an imaginary circle;

a flexible circumferential web piece extending between adjacent pairs of said contact patches such that each contact patch is supported, in a circumferential direction, by two of said circumferential web pieces;

a flexible radial web piece extending radially inwardly from each of said contact patches for supporting respective ones of said contact patches in a radial direction;

a central hoop member engaged with inner ends of said radial web pieces wherein an annular area is defined between said circumferential web pieces and said central hoop member; and wherein, in the absence of forces applied to said restraining device, said restraining device is substantially flat and, in a use position with said contact patches pressed inwardly and held in position by an interior surface of a drink container, said restraining device defines a smooth concave curve extending across the entire width of said restraining device.

2. The restraining device of claim 1 wherein said circumferential web pieces are spaced radially inwardly from said imaginary circle circumscribing said contact patches.

3. The restraining device of claim 2 wherein said circumferential web pieces are arcuate and each circumferential web piece is formed with a center of curvature located radially outwardly from a respective circumferential web piece.

4. The restraining device of claim 1 wherein each said contact patch defines a width, in the circumferential direction, which is greater than a width defined by a respective radial web piece, in the circumferential direction.

5. The restraining device of claim 1 wherein, in the use position, said restraining device is adapted to be flexed to engage interior surfaces of drink containers having interior diameters ranging from about 93 percent to about 57 percent of the diameter of the area circumscribed by the imaginary circle when said restraining device is flat.

6. The restraining device of claim 1 wherein restraining device is formed of a flexible, resilient material having a durometer of about 35 to 70.

7. The restraining device of claim 6 wherein said material comprises PVC.

8. The restraining device of claim 1 wherein said central hoop member circumscribes a circular aperture and provides a flexible support for said inner ends of said radial web pieces.

9. An ice cube restraining device for use in combination with a drink container having generally upright sides, said restraining device comprising:

a plurality of contact patches for engaging an interior surface of a drink container, said plurality of contact patches being substantially equally spaced from each other in a circumferential direction within an area circumscribed by an imaginary circle;

a plurality of flexible circumferential web pieces, each said circumferential web piece extending between adjacent pairs of said contact patches such that each said contact patch is supported, in a circumferential direction, by two of said circumferential web pieces, and each said circumferential web piece defining an arcuate member having a center of curvature located radially outwardly from a respective circumferential web piece;

a plurality of flexible radial web pieces, each said radial web piece extending radially inwardly from a respective one of said contact patches for supporting respective ones of said contact patches in a radial direction; and a central hoop member engaged with inner ends of said radial web pieces wherein an annular area is defined between said circumferential web pieces and said central hoop member; and wherein, in the absence of forces applied to said restraining device, said restraining device is substantially flat and, in a use position with said contact patches pressed inwardly and held in position by an interior surface of a drink container, said restraining device defines a smooth concave curve extending across the entire width of said restraining device.

10. The restraining device of claim 9 wherein each said contact patch defines a width, in the circumferential direction, which is greater than a width defined by a respective radial web piece, in the circumferential direction.

11. The restraining device of claim 9 wherein, in the use position, said restraining device is adapted to be flexed to engage interior surfaces of drink containers having interior diameters ranging from about 93 percent to about 57 percent of the diameter of the area circumscribed by the imaginary circle when said restraining device is flat.

12. The restraining device of claim 9 wherein restraining device is formed of a flexible, resilient material having a durometer of about 35 to 70.

13. The restraining device of claim 12 wherein said material comprises PVC.

14. The restraining device of claim 9 wherein said central hoop member circumscribes a circular aperture and provides a flexible support for said inner ends of said radial web pieces.

15. An ice cube restraining device for use in combination with a drink container having generally upright sides, said restraining device formed of a polymeric material having a durometer of about 55 and comprising:

a plurality of discrete contact patches for engaging an interior surface of a drink container, said plurality of contact patches being substantially equally spaced from each other in a circumferential direction within an area circumscribed by an imaginary circle;

a plurality of flexible circumferential web pieces formed integrally with said contact patches, each said circumferential web piece extending between adjacent pairs of said contact patches such that each said contact patch is supported, in a circumferential direction, by two of said circumferential web pieces, and each said circumferential web piece defining an arcuate member having a center of curvature located radially outwardly from a respective circumferential web piece;

a plurality of flexible radial web pieces, each said radial web piece formed integrally with and extending radially inwardly from a respective one of said contact patches for supporting respective ones of said contact patches in a radial direction;

a central hoop member circumscribing a circular aperture and formed integrally with inner ends of said radial web pieces wherein an open annular area is defined between said circumferential web pieces and said central hoop member; and wherein said restraining device has a flat non-use configuration and a curved use configuration such that in said non-use configuration, said plurality of contact patches, said circumferential web pieces, said radial web pieces and said central hoop member all lie in a common plane, and in said use configuration, said restraining device defines a smooth concave curve with said contact patches lying within an area circumscribed by an imaginary circle having a maximum diameter ranging from about 93 percent to about 57 percent of the diameter of an imaginary circle circumscribing outer portions of said contact patches positioned in said flat non-use configuration.

* * * * *